US006907618B2

(12) United States Patent
Rausch et al.

(10) Patent No.: US 6,907,618 B2
(45) Date of Patent: Jun. 21, 2005

(54) HUNTING WADERS AND JACKET COMBINATION

(76) Inventors: Fred W. Rausch, 10409 Riverview Dr., Fort Smith, AR (US) 72903; Dennis J. Paskey, 3000 S. 105th St., Fort Smith, AR (US) 72903

( * ) Notice: Subject to any disclaimer, the term of this patent is extended or adjusted under 35 U.S.C. 154(b) by 0 days.

(21) Appl. No.: 10/743,294

(22) Filed: Dec. 23, 2003

(65) Prior Publication Data

US 2004/0133960 A1 Jul. 15, 2004

Related U.S. Application Data

(63) Continuation-in-part of application No. 10/119,111, filed on Apr. 10, 2002, now Pat. No. 6,668,383.
(60) Provisional application No. 60/294,633, filed on Jun. 1, 2001.

(51) Int. Cl.[7] ..... A41D 13/00
(52) U.S. Cl. ..... 2/82; 2/69; 2/79
(58) Field of Search ..... 2/82, 81, 69, 69.5, 2/79, 96, 84, 1, 80, 83, 108, 859.3, 94, 88, 102; 441/102–110, 95

(56) References Cited

U.S. PATENT DOCUMENTS

| | | | | | |
|---|---|---|---|---|---|
| 492,643 | A | | 2/1893 | Van Oostrum | |
| 1,077,177 | A | | 10/1913 | Vagas et al. | |
| 1,098,110 | A | * | 5/1914 | Heberlein | 441/104 |
| 1,973,421 | A | * | 9/1934 | Wallace | 2/80 |
| 2,087,246 | A | | 7/1937 | Edwards | |
| D113,194 | S | | 1/1939 | Storey et al. | |
| 2,306,488 | A | * | 12/1942 | Morner | 441/103 |
| 2,379,498 | A | * | 7/1945 | Shaw | 2/82 |
| 2,585,840 | A | * | 2/1952 | Reynolds | 2/79 |
| 2,616,087 | A | * | 11/1952 | Werber | 2/79 |
| 3,130,416 | A | | 4/1964 | Mitchell et al. | |
| 3,444,570 | A | * | 5/1969 | Smith | 441/104 |
| D285,140 | S | | 8/1986 | Ellenberger | |
| 4,858,342 | A | | 8/1989 | Nicholson et al. | |
| 4,912,860 | A | | 4/1990 | Keller | |
| 5,022,096 | A | | 6/1991 | Pacanowsky | |
| 5,081,718 | A | | 1/1992 | Carman et al. | |
| D336,355 | S | | 6/1993 | Holton | |
| 5,331,685 | A | * | 7/1994 | Belgard | 2/79 |
| D353,254 | S | | 12/1994 | Welch | |
| D358,928 | S | | 6/1995 | Slagle et al. | |
| D369,454 | S | | 5/1996 | Olsen | |
| 6,154,884 | A | * | 12/2000 | Dehner | 2/69 |
| 6,370,692 | B1 | * | 4/2002 | Duyn et al. | 2/86 |
| 6,668,383 | B2 | * | 12/2003 | Rausch et al. | 2/82 |

* cited by examiner

*Primary Examiner*—Gloria M. Hale
(74) *Attorney, Agent, or Firm*—Richard C. Litman

(57) ABSTRACT

An outfit having attached jacket and waders. The jacket portion has at least one zipper to facilitate a wearer's entry into the outfit. Because the waders and the jacket are attached to each other, the elements cannot get in between the waders and the jacket, i.e. above the waders and below the jacket. Further, the combination will prevent the separation of the waders and the jacket and the inconvenience which may occur (i.e. by misplacing one) from their separation. The instant invention insures that the waders and the jacket are always together. The instant invention also provides a flap over the zipper and accordioned material inside the zipper to increase the water resistance of the outfit.

9 Claims, 4 Drawing Sheets

HUNTING WADERS AND JACKET COMBINATION

CROSS-REFERENCE TO RELATED APPLICATION

This application is a continuation-in-part of U.S. patent application Ser. No. 10/119,111, filed Apr. 10, 2002, now U.S. Pat. No. 6,668,383, which claims the benefit of U.S. Provisional Patent Application Ser. No. 60/294,633, filed Jun. 1, 2001.

BACKGROUND OF THE INVENTION

1. Field of the Invention

The present invention relates to a waders and jacket combination in which the waders and jacket are attached to each other.

2. Description of Related Art

Protective suits and combination garments are well-known, as shown in U.S. Design Pat. No. 336,355 issued on Jun. 15, 1993 to Jeffrey C. Holton, U.S. Pat. No. 353,254, issued on Dec. 13, 1994, U.S. Pat. No. 358,928, issued on Jun. 6, 1995 to Timothy Slagle et al., and U.S. Pat. No. 369,454 issued on May 7, 1996 to Neil Olsen. U.S. Pat. No. 492,643, issued on Feb. 28, 1893 to O. Van Oostrum, U.S. Pat. No. 2,087,246, issued on Jul. 20, 1937 to J. M. Edwards, and U.S. Pat. No. 3,130,416, issued on Apr. 28, 1964 to Jack Mitchell et al. further exemplify the state of the art in these protective garments.

Additionally, waders are common in the related art, e.g. as seen in U.S. Design Pat. No. 285,140, issued on Aug. 19, 1986 to Jack Ellenberger, and taught in U.S. Pat. No. 4,858,342, issued on Aug. 22, 1989 to Joh Nicholson et al., U.S. Pat. No. 4,912,860, issued on Apr. 3, 1990, to Robert Keller, U.S. Pat. No. 5,022,096, issued on Jun. 11, 1991 to David Pacanowsky, and U.S. Pat. No. 5,081,718, issued on Jan. 21, 1992 to David Carman et al.

Coats having head coverings are shown in U.S. Design Pat. No. 113,194, issued on Jan. 31, 1939 to Emma Story, and taught in U.S. Pat. No. 1,077,177, issued on Oct. 28, 1913 to Andrew Vagas et al.

None of the above inventions and patents, taken either singly or in combination, is seen to describe the instant invention as claimed.

SUMMARY OF THE INVENTION

The present invention is a waders and jacket combination in which the waders and jacket are attached to each other. Because the waders and the jacket are attached to each other, the elements cannot get in between the waders and the jacket, i.e. above the waders and below the jacket. Further, the combination will prevent the separation of the waders and the jacket and the inconvenience which may occur (i.e. by misplacing one) from their separation. The instant invention insures that the waders and the jacket are always together. The attachment will preferably be made by heat sealing the waders and the jacket together. However, it is noted that any manner which accomplishes the attachment of the waders and the jacket is contemplated by this invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
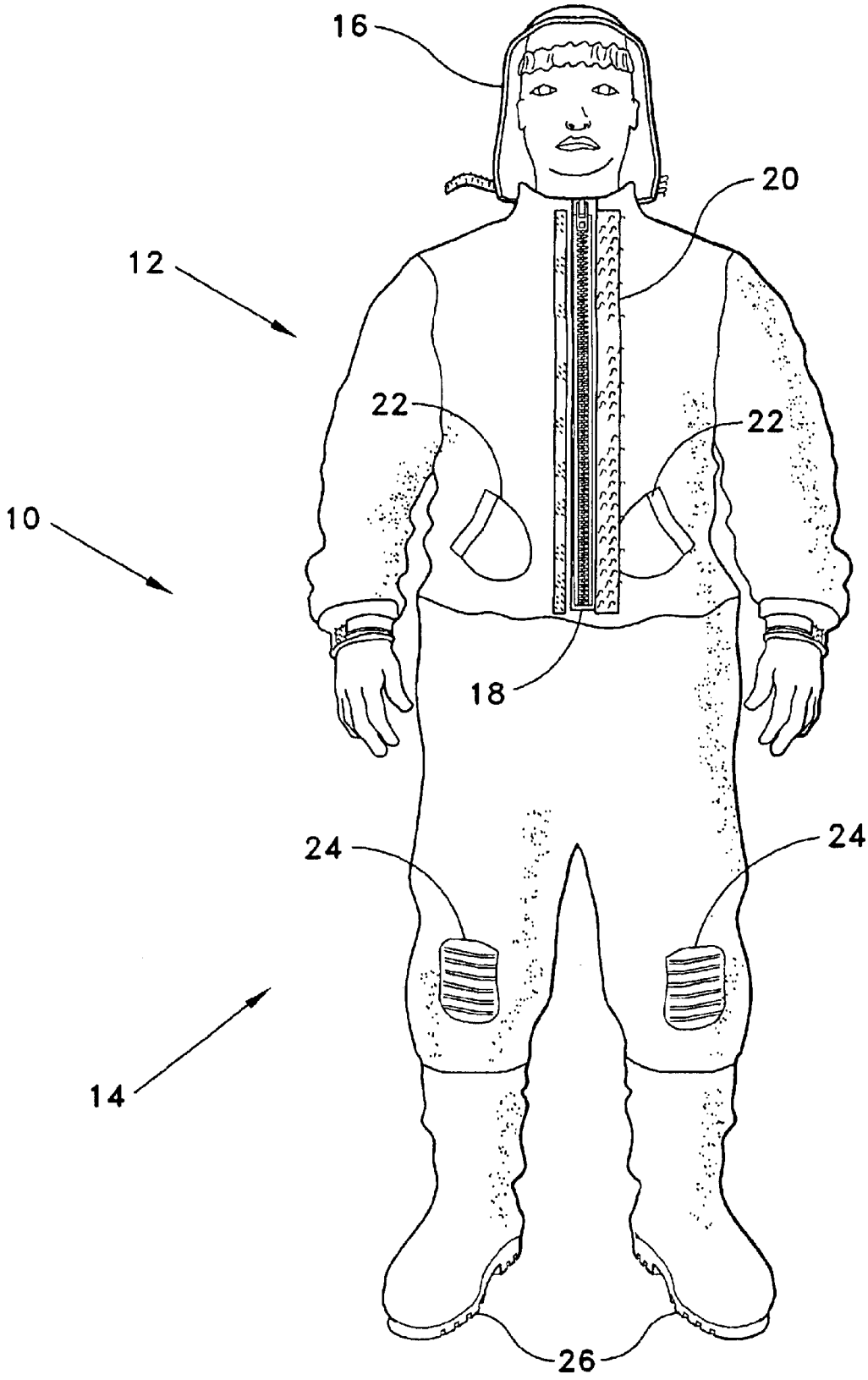
FIG. 1 is a front elevational view of a hunting waders and jacket combination having one zipper according to the present invention.
Figure 2:
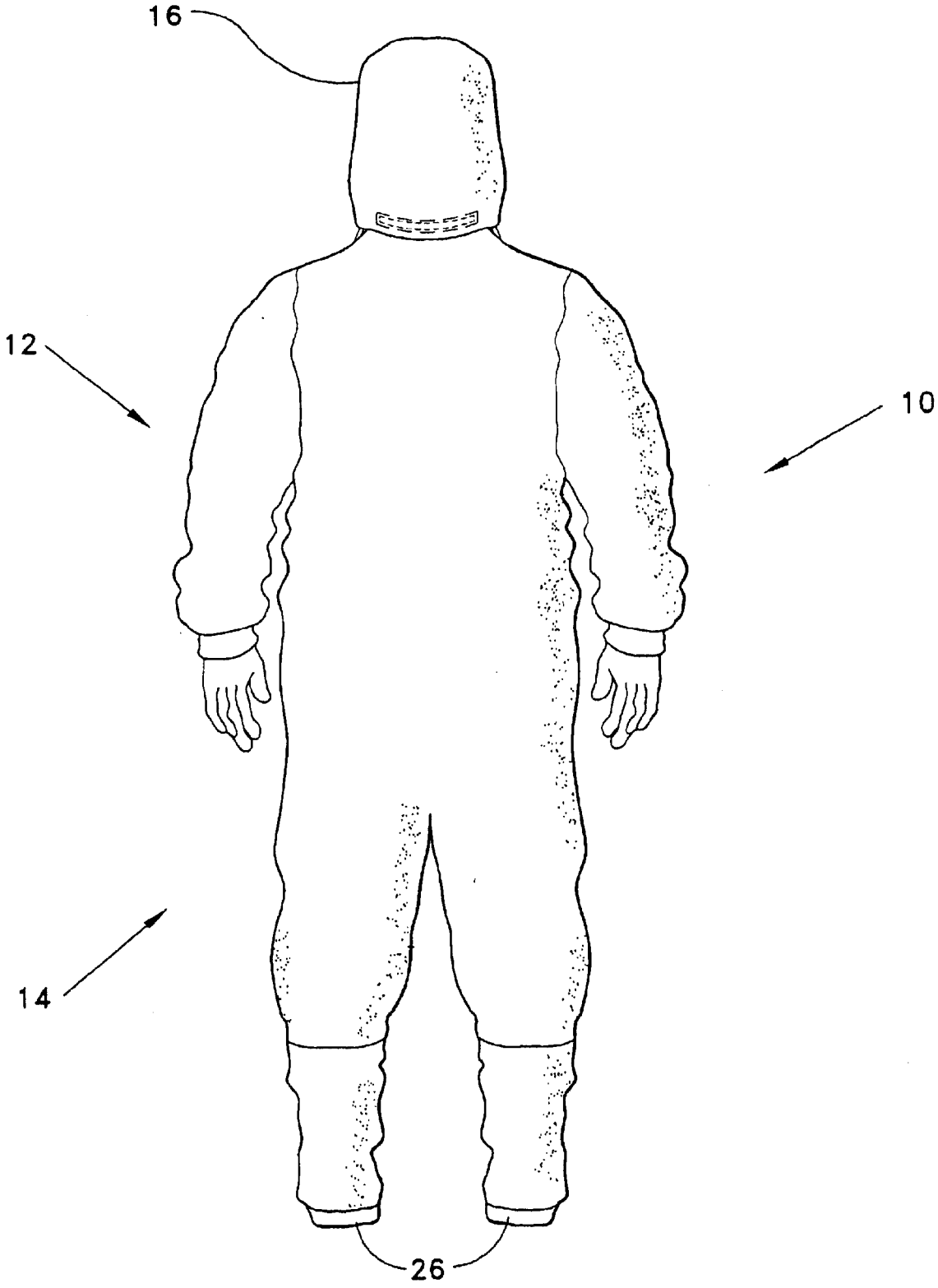
FIG. 2 is a rear elevational view thereof.

The present invention is depicted in the attached figures. FIGS. 1 and 2 show the front and rear views of an outfit 10 having a jacket 12 attached to a pair of waders 14. The jacket 12 may be made of Gore-Tex® (a water-repellant, breathable laminated fabric) or canvas material, has a turtle neck collar, which may be fastened with Velcro® (hook and loop fasteners) or zippers that zip to the collar.

The jacket 12 includes a detachable or fold-away hood 16 and a single zipper 18 for allowing entry into the outfit. The zipper 18, shown in FIG. 1, is at a location indicating front entry of a wearer into the outfit 10; however, it is noted that locating the zipper to another portion of the jacket is well within the scope of the instant invention. The zipper 18 is waterproof and may be covered with a flap 20 of material to further minimize the effect of water, i.e. to make the outfit even more water resistant. Pockets 22 may be located on the front of the jacket 12 for use as hand warmers.

The waders 14 are waterproof and made of a material such as Cordura® (a durable fabric resistant to punctures, cuts, tears and scuffs), neoprene, vinyl, or rubber. The waders 14 may include buckle-release suspenders (not shown), knee pads 24 for reinforcement and attached boots 26. The jacket 12 may include a holder for bullets (not shown). The boots 26 are preferably lined with Thinsulate® (a hypoallergenic low-loft synthetic fabric used in place of down for insulation).

Figure 3:
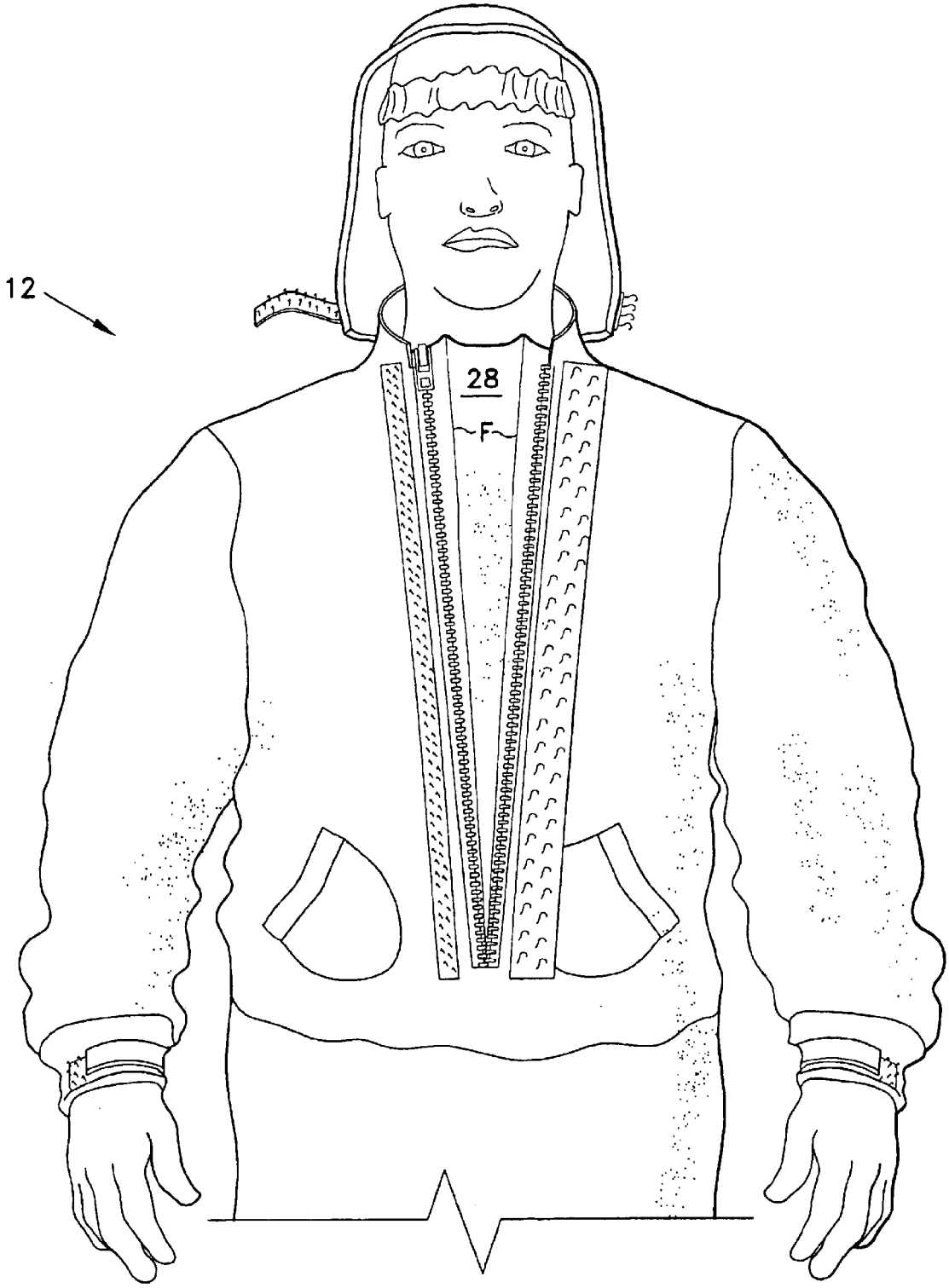
FIG. 3 is a front view of the jacket showing the detail of the accordioned material.

FIG. 3 illustrates another way to further minimize the effect of water on the outfit 10. Accordioned material 28 permanently attached to the inside of the zipper 18 will capture any water which gets through the zipper 18 and protect the wearer of the outfit 10. This arrangement can be used with or without the flap 20. The advantage of this material 28, which accordions (or folds) along fold lines F, is that it prevents the outfit from fully opening (thereby increasing its water resistance) while allowing the expansion of the outfit for ease of a wearer's entry. The present invention contemplates the use of additional fold lines to increase the expansion of the outfit. The material 28 is expanded when the jacket is open as in FIG. 3. When the jacket is closed, as in FIG. 1, the material 28 is folded (or accordioned) about the fold lines F.

FIG. 1 illustrates the use of one zipper 18. The advantage of using only one zipper is that there are the fewest possible points of entry for water, an important consideration in the design of a garment for hunters and others who may be exposed to water. Because of ability of the flap 20 and the accordioned material 28 to minimize the wearer's exposure to water, the addition of an extra zipper should not increase the wearer's exposure to water.

Figure 4:
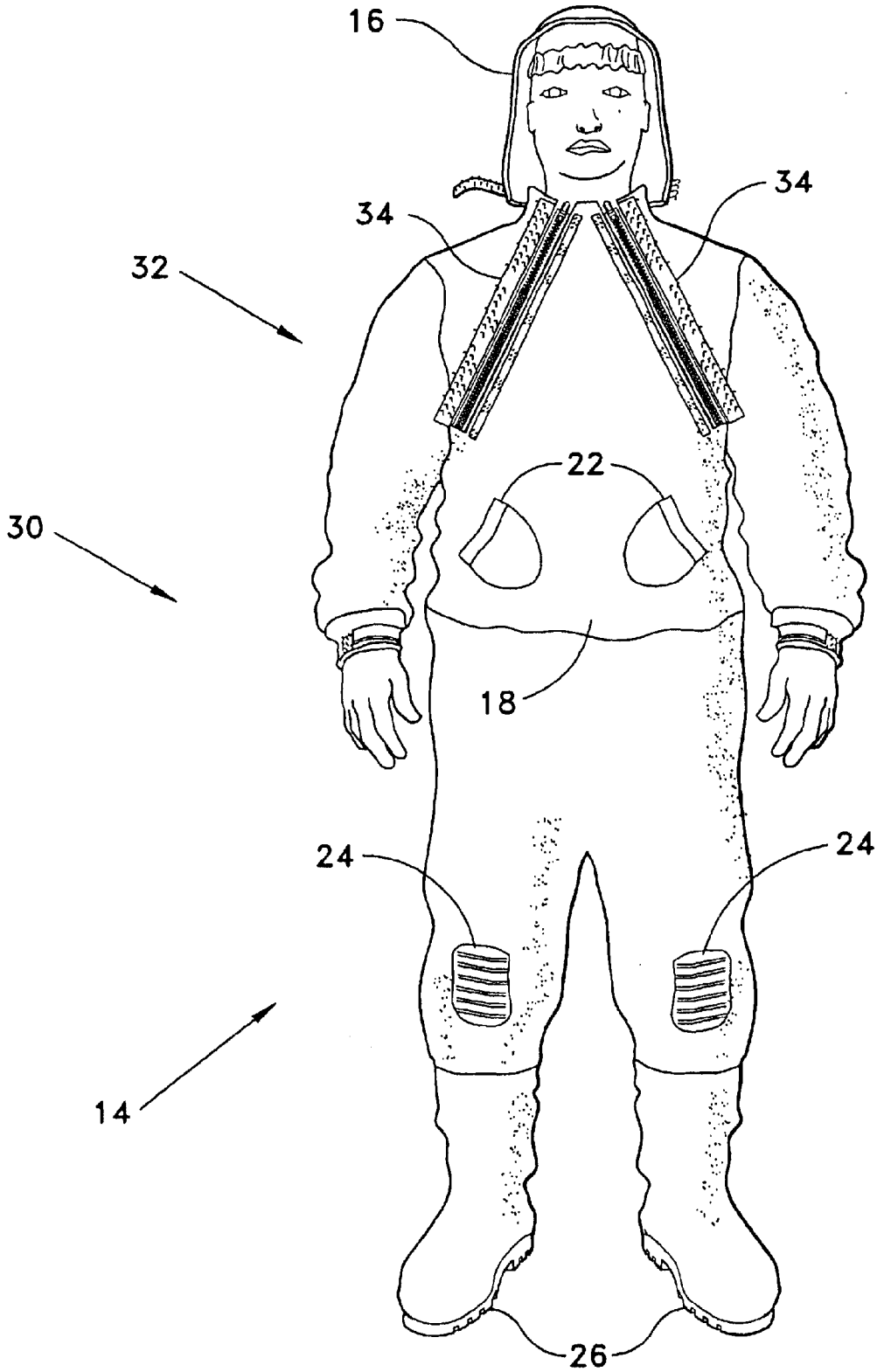
FIG. 4 is a front elevational view of a hunting waders and jacket combination having two zippers.

An outfit 30 having a jacket 32 with two zippers 34 is also contemplated by the present invention and is shown in FIG. 4. Opening the zippers 34 of the jacket 32 will result in a flap that can be folded over, allowing for easy entry of a wearer into the outfit. This two-zipper arrangement can be used with the flap 20 or the accordioned material 28 to reduce exposure to water.

It is to be understood that the present invention is not limited to the sole embodiments described above, but encompasses any and all embodiments within the scope of the following claims.

We claim:

1. An one-piece outfit comprising:

waders having permanently attached boots;

a jacket permanently attached to said waders and including at least one entry zipper; and means for minimizing the effect of water on said at least one zipper;

wherein said means for minimizing includes an accordioned material disposed behind said at least one zipper for preventing and trapping any water penetrating said zipper.

2. The outfit of claim 1 wherein said means for minimizing the effect also includes a flap attached to said jacket for fastening over said at least one zipper.

3. The outfit of claim 1 wherein said accordioned material is permanently attached behind said at least one zipper, and said accordioned material extending at least the length of said at least one zipper.

4. The outfit of claim 1 further including a detachable hood.

5. The outfit of claim 1 wherein said at least one zipper is two zippers whereby the upper portion of said jacket can be folded in a flap allowing easy entry into said outfit.

6. A method of making an outfit comprising:

providing waders having attached boots;

providing a jacket having at least one entry zipper;

attaching the waders to the jacket; and attaching accordioned material behind and at least the length of the at least one zipper;

whereby any water penetrating the at least one zipper is trapped by the material;

wherein the accordioned material prevents any water from entering the outfit.

7. The method of claim 6 wherein said attaching includes heat sealing.

8. The method of claim 6 further including attaching a hood to said jacket.

9. The method of claim 6 further including attaching a flap to said jacket for fastening over said at least one zipper.

* * * * *